US009283777B1

(12) United States Patent
Nihashi

(10) Patent No.: US 9,283,777 B1
(45) Date of Patent: Mar. 15, 2016

(54) PRINTER APPARATUS

(71) Applicant: TOSHIBA TEC KABUSHIKI KAISHA, Shinagawa-ku, Tokyo (JP)

(72) Inventor: Kiyotaka Nihashi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/524,143

(22) Filed: Oct. 27, 2014

(51) Int. Cl.
*B41J 2/00* (2006.01)
*B41J 11/00* (2006.01)

(52) U.S. Cl.
CPC ..... *B41J 11/0045* (2013.01)

(58) Field of Classification Search
CPC ..... B41J 11/045
USPC ..... 347/110
See application file for complete search history.

(56) References Cited

U.S. PATENT DOCUMENTS

2010/0230889 A1* 9/2010 Eoka et al. ..... 271/3.14

FOREIGN PATENT DOCUMENTS

JP 2010-214617 9/2010

* cited by examiner

*Primary Examiner* — Stephen Meier
*Assistant Examiner* — Alexander D Shenderov
(74) *Attorney, Agent, or Firm* — Amin, Turocy & Watson, LLP

(57) ABSTRACT

A printer apparatus comprises an insertion and discharging port; a first paper conveyance path configured to convey a first printing medium inserted from the insertion and discharging port in a downstream direction towards a given printing position, and convey the first printing medium in a direction opposite to the downstream direction to discharge the first printing medium from the insertion and discharging port; a first printing section configured to carry out printing on the first printing medium conveyed to the printing position; a second printing section configured at the downstream side of the first printing section when seen from the direction of the insertion and discharging port to have a printing method different from that of the first printing section; a second paper conveyance path configured to merge with the first paper conveyance path at the downstream side of the first printing section of the first paper conveyance path to discharge a second printing medium printed by the second printing section through the first paper conveyance path from the insertion and discharging port; and a page turning mechanism configured at the downstream side of a mergence section of the first paper conveyance path and the second paper conveyance path to have a page turning function of turning the page of the first printing medium.

4 Claims, 4 Drawing Sheets

PRINTER APPARATUS

FIELD

Embodiments described herein relate to a printer apparatus provided with a printing mechanism having different printing methods.

BACKGROUND

In an ATM (AUTOMATED TELLER MACHINE) device of a bank and the like, printing is carried out on a passbook of a customer by a dot impact printing mechanism; and when a business form such as a transaction description and the like is issued, printing is carried out on thermal paper loaded in a printer apparatus by a thermal printing mechanism. There is also a request to reduce the size of the ATM device, and in recent years, it has been known to arrange different printing mechanisms (dot impact printing mechanism and thermal printing mechanism) and to share the conveyance path in the ATM device.

In a passbook, the printable lines of one page are decided. Thus, it is necessary to turn a page to the next (new) page of the passbook to carry out printing on when the printable lines of the page during a printing process are used up. In this case, it is required to discharge the passbook from the ATM device to the outside for a customer to open a new page and then insert the opened passbook into the ATM device. However, there remains a problem that page turning takes time because the passbook needs to be discharged from the ATM device to the outside to be opened in a new page.

DETAILED DESCRIPTION

In accordance with one embodiment, a printer apparatus comprises an insertion and discharging port; a first paper conveyance path configured to convey a first printing medium inserted from the insertion and discharging port in a downstream direction towards a given printing position, and convey the first printing medium in a direction opposite to the downstream direction to discharge the first printing medium from the insertion and discharging port; a first printing section configured to carry out printing on the first printing medium conveyed to the printing position; a second printing section configured at the downstream side of the first printing section when seen from the direction of the insertion and discharging port to have a printing method different from that of the first printing section; a second paper conveyance path configured to merge with the first paper conveyance path at the downstream side of the first printing section of the first paper conveyance path to discharge a second printing medium printed by the second printing section through the first paper conveyance path from the insertion and discharging port; and a page turning mechanism configured at the downstream side of a mergence section of the first paper conveyance path and the second paper conveyance path to have a page turning function of turning the page of the first printing medium.

Hereinafter, the printer apparatus according to the present embodiment is described in detail with reference to the accompanying drawings.

Figure 1:
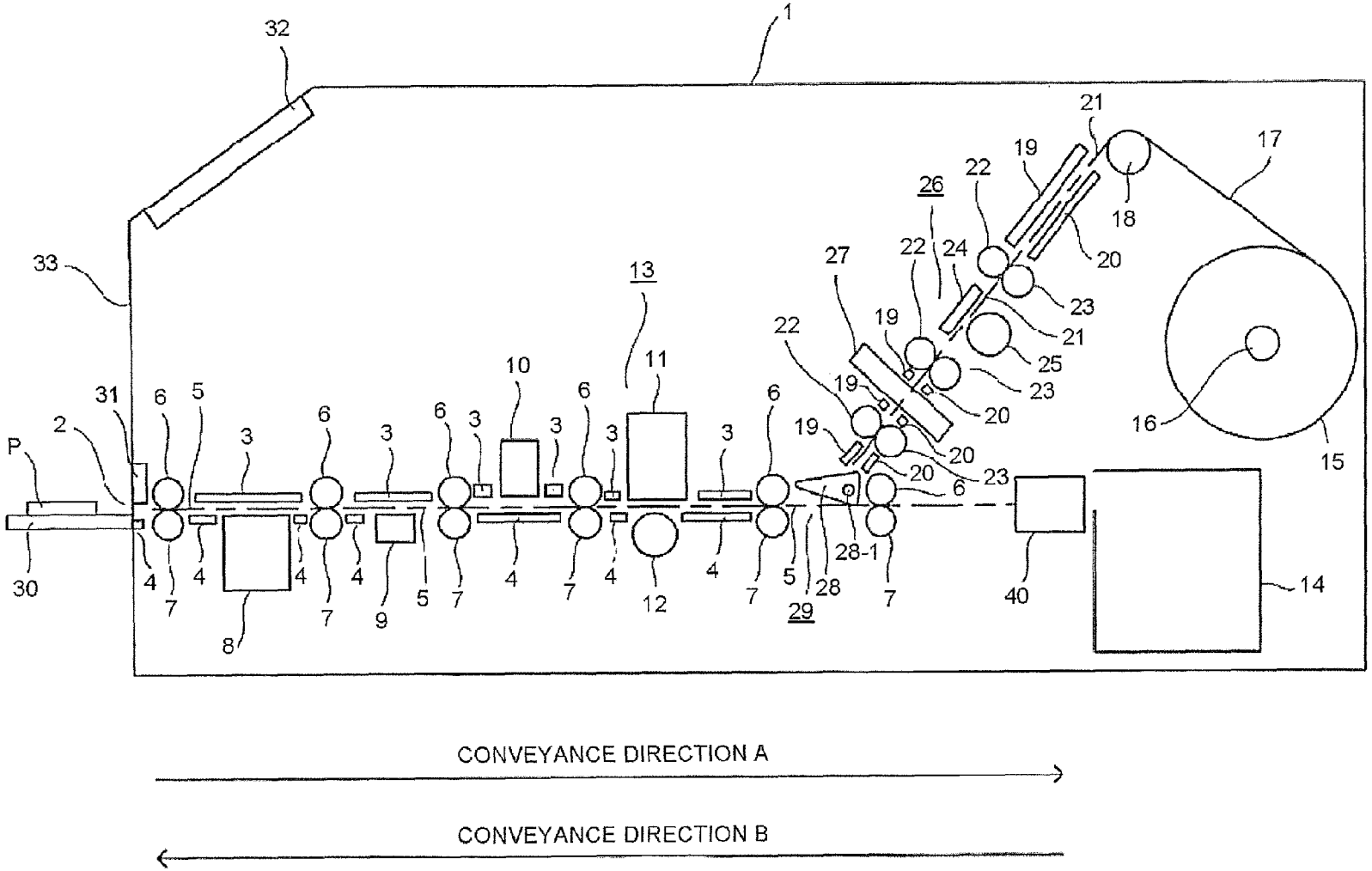
FIG. 1 is a constitution diagram illustrating the main portions of a printer apparatus according to one embodiment.

FIG. 1 is a constitution diagram illustrating the main portions of the printer apparatus according to the present embodiment.

A printer apparatus 1 is provided with a plurality of different printing mechanisms. In addition, in the following description of the present embodiment, the left side in FIG. 1 is referred to as a front side of the printer apparatus 1 and the right side in FIG. 1 is referred to as a rear side of the printer apparatus 1.

At the front side of the printer apparatus 1, an insertion and discharging port 2 is arranged for inserting a booklet P such as a passbook, or discharging the printed booklet P such as a passbook or later-described roll paper 15 issued as a business form which is cut after the printing is completed to the outside of the printer apparatus 1. In addition, in the present embodiment, the roll shape paper is referred to as the roll paper 15, and the business form obtained by cutting the roll paper 15 after a required printing operation is carried out on the roll paper 15 is referred to as a business form C.

A collection box 14 is arranged at the rear side of the printer apparatus 1 to collect and store a booklet P and a business form C a user forgets to take away.

A first conveyance upper guide 3 and a first conveyance lower guide 4 are arranged to extend in the space from the insertion and discharging port 2 to the collection box 14, and the space between the first conveyance upper guide 3 and the first conveyance lower guide 4 is regarded as a first paper conveyance path 5 for conveying the booklet P and the business form C. Further, in the description of the present embodiment, the direction of the conveyance of the booklet P or the business form C from the insertion and discharging port 2 towards the collection port 14 is referred to as a conveyance direction A, and the left side in FIG. 1 (that is, the front side) is referred to as an upstream side and the right side is referred to as a downstream side unless otherwise noted.

At the downstream side of the insertion and discharging port 2 in the conveyance direction A, a feed roller 6 which can be rotated by a motor (not shown) is arranged opposite to an idler roller 7 across the first paper conveyance path 5. The feed roller 6 and the idler roller 7 are in pairs, so as to clamp and convey the booklet P and the business form C. In addition, a plurality of pairs of feed roller 6 and idler roller 7 are arranged along the first paper conveyance path 5.

Further, an alignment section 8 is arranged at the downstream side of the insertion and discharging port 2 in the conveyance direction A. The alignment section 8 consisting of a paper position detection sensor, a shutter, a paper pinch mechanism, an alignment end wall (none is shown) and the like corrects the skew, misalignment and the like of the booklet P inserted from the insertion and discharging port 2, and moves the booklet P to a pre-set position and attitude.

A MS (MAGNETIC STRIPE) reading/writing section 9 is arranged at the downstream side of the alignment section 8 in the conveyance direction A. The MS reading/writing section 9 carries out information reading and writing processing with a magnetic stripe section (not shown) arranged on the back of the booklet P.

A PLF (PAGE LINE FINDER) section 10 is arranged at the downstream side of the MS reading/writing section 9 in the conveyance direction A. The PLF section 10 confirms the current opened page of the booklet P.

A dot head 11 is arranged opposite to a platen roller 12 at the downstream side of the PLF section 10 in the conveyance direction A across the first paper conveyance path 5. The dot head 11 and the platen roller 12 constitute a first printing section 13 which carries out printing on the booklet P.

Further, a page turning mechanism 40 for turning a page of the booklet P is arranged at the downstream side of the first printing section 13 in the conveyance direction A, and the collection box 14 is arranged at the downstream side of the page turning mechanism 40 in the conveyance direction A.

Further, at the rear side of the printer apparatus 1, the roll paper 15 serving as paper wound around a winding shaft 16 which is rotatably supported to a frame (not shown) is loaded.

The roll paper 15 includes a thermosensitive layer which generates color if heated only on a printing surface A17 serving as one surface thereof.

An idler roller 18 is arranged in the printer apparatus 1 to apply a given tension to the roll paper 15.

A second conveyance upper guide 19 and a second conveyance lower guide 20 are arranged to extend in a space from the idler roller 18 towards the front side of the printer apparatus 1, and the space between the second conveyance upper guide 19 and the second conveyance lower guide 20 is regarded as a second paper conveyance path 21 for conveying the roll paper 15. The second paper conveyance path 21 merges with the first paper conveyance path 5 at a position between the first printing section 13 and the page turning mechanism 40. In addition, in the description of the present embodiment, the mergence position of the first paper conveyance path 5 and the second paper conveyance path 21 is referred to as a mergence section 29, and the direction of the conveyance of the roll paper 15 and a business form C from the idler roller 18 via the mergence section 29 towards the insertion and discharging port 2 is referred to as a conveyance direction B.

At the downstream side of the idler roller 18 in the conveyance direction B, a feed roller 22 which can be rotated by a motor (not shown) is arranged opposite to an idler roller 23 across the second paper conveyance path 21. The feed roller 22 and the idler roller 23 are in pairs, so as to clamp and convey the roll paper 15. In addition, a plurality of pairs of feed roller 22 and idler roller 23 are arranged along the second paper conveyance path 21.

At the downstream side of the idler roller 18 in the conveyance direction B, a thermal print head 24 and a platen roller 25 which can be rotated by a motor (not shown) are arranged opposite to each other across the second paper conveyance path 21. The thermal print head 24 and the platen roller 25 constitute a second printing section 26 which carries out printing on the printing surface A17 of the roll paper 15.

A cutter 27 is arranged at the downstream side of the second printing section 26 in the conveyance direction B. The cutter 27 includes a fixed blade and a movable blade (neither of which is shown), and cuts the roll paper 15 inserted to a slit (not shown) arranged in the cutter 27 by sliding and moving the movable blade towards the fixed blade under the driving of a cutter motor (not shown). The cutter 27, which is not limited to a so-called slide type cutter sliding the movable blade towards the fixed blade described herein, may be also a rotary type cutter cutting paper by rotating the movable blade towards the fixed blade.

The first paper conveyance path 5 and the second paper conveyance path 21 merge with each other at the downstream side of the cutter 27 in the conveyance direction B. A flapper 28 is arranged at the mergence section 29 serving as the mergence position. The flapper 28 can be rotated around a flapper rotation shaft 28-1; if the flapper 28 is rotated anticlockwise, the second paper conveyance path 21 is communicated with the first paper conveyance path 5, and if the flapper 28 is rotated clockwise, the paper is only conveyed on the first paper conveyance path 5 from the insertion and discharging port 2 to the collection box 14. Usually, the flapper 28 is energized clockwise by an energization module (not shown), thus, the paper can be conveyed on the first paper conveyance path 5 from the insertion and discharging port 2 to the collection box 14. A flapper rotation mechanism (not shown) is driven to rotate the flapper 28 anticlockwise to communicate the second paper conveyance path 21 with the first paper conveyance path 5.

Further, at the front side of the printer apparatus 1 nearby the insertion and discharging port 2, an insertion and discharging table 30 is arranged for temporarily placing the booklet P when inserting the booklet P into the printer apparatus 1 or the booklet P or the business form C when discharging the booklet P or the business form C towards a user. In addition, a collection sensor 31 is arranged at the insertion and discharging port 2 to detect whether or not the booklet P or the business form C is taken away by the user. Further, a display section 32 is arranged at the upper portion of the printer apparatus 1 to display various states of the printer apparatus 1, including an error such as a paper jam, paper out and the like.

Figure 2:
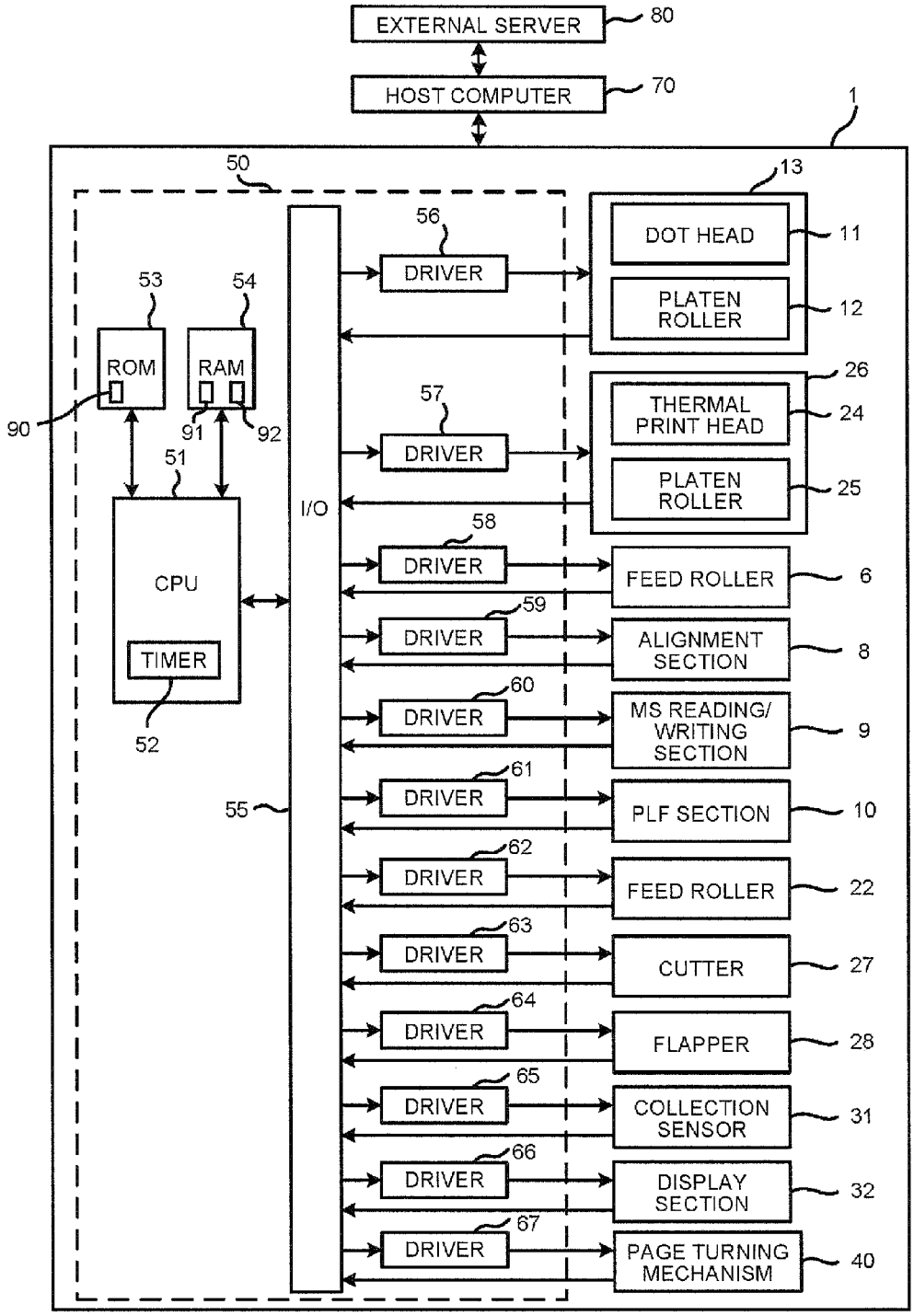
FIG. 2 is a control block diagram of the printer apparatus according to the present embodiment.

FIG. 2 is a block diagram illustrating the control circuit constitution of the printer apparatus 1 according to the present embodiment. A control section 50 carries out various controls on paper conveyance, printing, paper cutting, paper discharging, paper collection, state display of the printer apparatus and page turning of the booklet P.

The control section 50 is constituted by, for example, a microcomputer which carries out connection with a host computer 70 and various controls. Further, the host computer 70 is connected with an external server 80 of a financial institution managing the savings deposit information and the like.

A central processing unit (CPU) 51 of the control section 50 carries out, according to programs, various operations and various controls such as paper conveyance control, printing control, paper cutting control, paper discharging control, paper collection control, control on displaying state of the printer apparatus, booklet page turning control and the like.

Further, the CPU 51 comprises a timer 52 serving as a unit for carrying out time setting and time control.

A ROM 53 and a RAM 54 are arranged in the control section 50 as primary storage units for storing control programs executed by the CPU 51 or the data generated during a control process or an operation processing and the like.

The ROM 53 is a read-only memory in which control programs and tables and the like are stored, and the RAM 54 is a random access memory for storing the data generated during an operation process and the like.

An input/output unit (I/O) 55 is arranged in the control section 50 to acquire various input data from the host computer 70 and export a control output of the control section 50 to the host computer 70. The I/O 55 is connected with the CPU 51, the ROM 53 and the RAM 54 via a bus line.

The I/O 55 is connected with a first, a second, a third, a fourth, a fifth, a sixth, a seventh, an eighth, a ninth, a tenth, an eleventh and a twelfth drives 56, 57, 58, 59, 60, 61, 62, 63, 64, 65, 66 and 67 serving as units for exporting a control output.

The first driver 56 supplies a required drive output for the first printing section 13. The second driver 57 supplies a required drive output for the second printing section 26. The third driver 58 supplies a drive output for the feed roller 6. The fourth driver 59 supplies a drive output for the alignment section 8. The fifth driver 60 supplies a drive output for the MS reading/writing section 9. The sixth driver 61 supplies a drive output for the PLF section 10. The seventh driver 62 supplies a drive output for the feed roller 22. The eighth driver 63 supplies a drive signal for the cutter 27. The ninth driver 64 supplies a drive signal for the flapper 28. The tenth driver 65 supplies a drive output for the collection sensor 31. The eleventh driver 66 supplies a drive signal for the display section 32. The twelfth driver 67 supplies a drive signal for the page turning mechanism 40.

Figure 3:
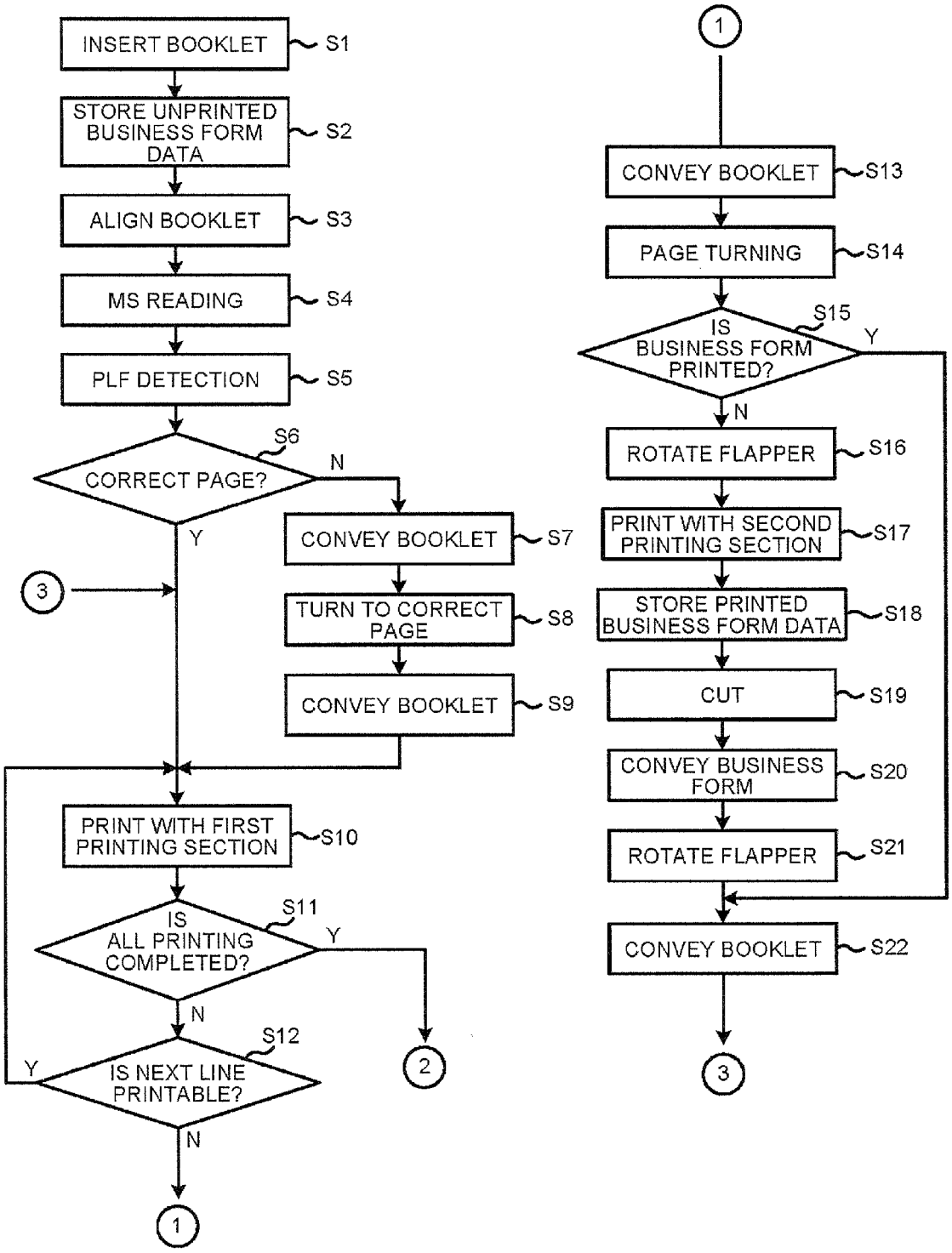
FIG. 3 is a flowchart illustrating printing operations of the printer apparatus which carries out printing on a booklet and a business form according to the present embodiment.
Figure 4:
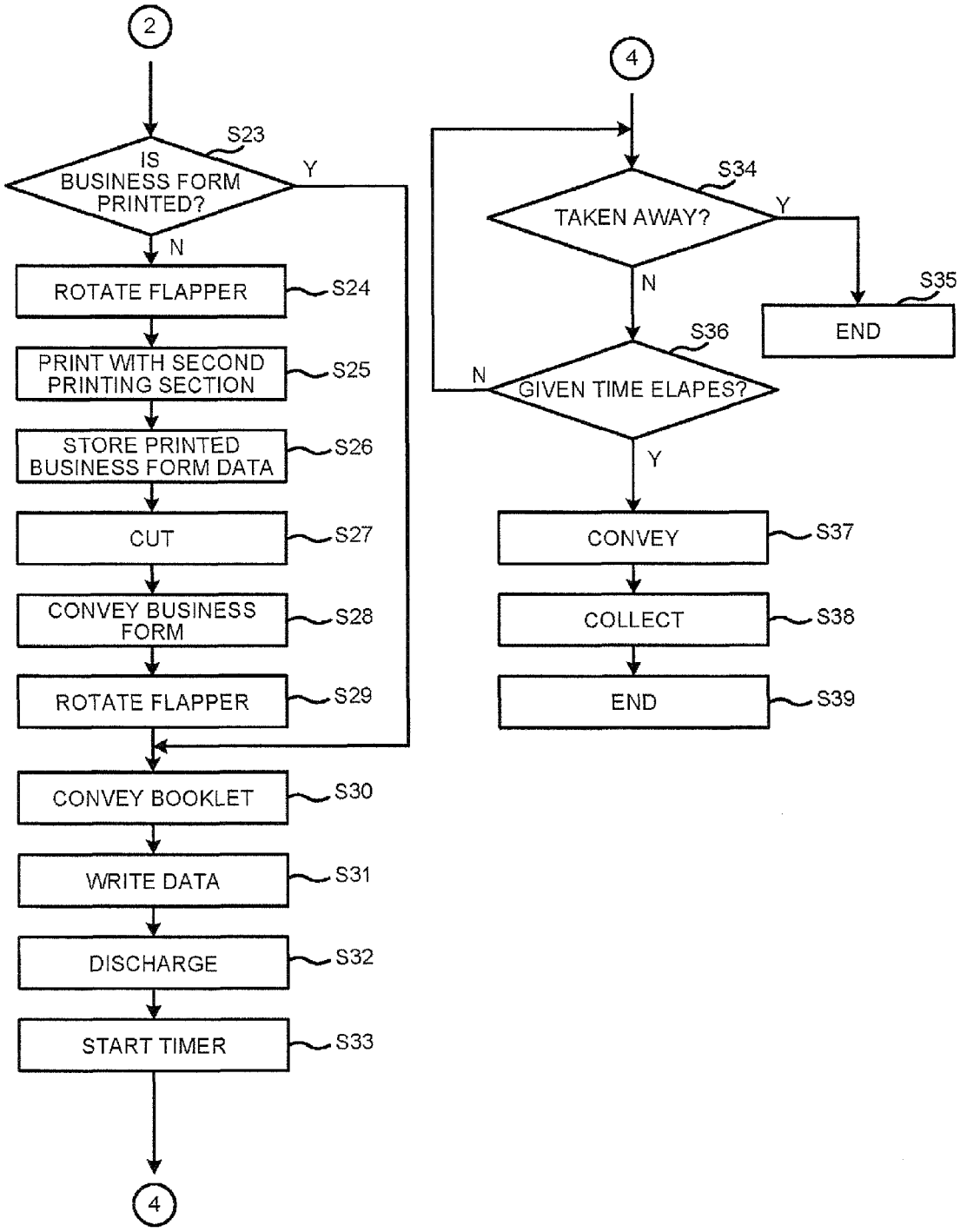
FIG. 4 is a flowchart illustrating printing operations of the printer apparatus which carries out printing on a booklet and a business form according to the present embodiment.

Hereinafter, the operations of the printer apparatus 1 are described with reference to FIG. 1, FIG. 3 and FIG. 4. The printer apparatus 1 is used in a state of being incorporated in the automated teller machine and the like.

The user carries out transaction processing with the external server 80 of a financial institution through operation on the screen of the automated teller machine (not shown). The user may desire to or not to print the transaction processing content on a passbook in different cases, however, in the present embodiment, it is assumed that the user desires to print the transaction processing content on the passbook.

The automated teller machine requests, according to the screen display and the like, the user to open the booklet P serving as the passbook and insert the opened passbook from the insertion and discharging port 2. The user opens the booklet P and inserts the opened booklet P from the insertion and discharging port 2 towards the rear direction of the printer apparatus 1 (S1).

At this time, the feed roller 6 and the idler roller 7 are rotated in the rotation direction to convey the booklet P in the conveyance direction A, and the booklet P clamped by the roller pair (feed roller 6 and idler roller 7) at the most upstream side in the conveyance direction A is started to be conveyed in the conveyance direction A.

Then, the control section 50 stores the unprinted data in a business form printing confirmation section (not shown) arranged in the RAM 54 (S2). As described later, the unprinted data is used to confirm whether or not the business form is printed, so as to prevent that a printing operation is repeatedly carried out on the same business form in a single transaction.

Next, the booklet P, if being conveyed in the conveyance direction A, enters the alignment section 8 first. The alignment section 8, which consists of a paper position detection sensor, a shutter, a paper pinch mechanism, an alignment end wall (none is shown) and the like, corrects the skew, misalignment and the like of the booklet P inserted from the insertion and discharging port 2 and moves the booklet P to the pre-set position and attitude (S3). In addition, alignment method of the booklet P is well-known, and therefore the detailed description thereof is omitted.

The booklet P moved to the pre-set position and attitude is further conveyed in the conveyance direction A, and then enters the MS reading/writing section 9. A magnetic stripe is arranged in the booklet P at the side of the MS reading/writing section 9. For example, customer information and information indicating the latest time of the printed transaction amount of this booklet P is recorded as magnetic data in the magnetic stripe, and the MS reading/writing section 9 acquires the information recorded in the magnetic stripe while the booklet P is being conveyed in the conveyance direction A (S4). In addition, the information indicating the latest time of the printed transaction amount of this booklet P which is not limited to be recorded in the magnetic stripe may be recorded in the external server 80.

The booklet P is further conveyed in the conveyance direction A, and then enters the PLF section 10. The PLF section 10 has a function of optically recognizing the current opened page and the printed lines of the booklet P serving as the passbook, and the page number of the booklet P and the information of the printed lines are acquired by passing the booklet P through the PLF section 10 (S5).

Then the control section 50 compares the information acquired by the PLF section 10 with the information indicating the latest time of the printed transaction amount of this booklet P acquired by the MS reading/writing section 9 to determine whether or not the booklet P is inserted into the printer apparatus 1 by the user with the correct page opened (S6). In addition, the "correct page" mentioned herein refers to a page having blank lines to print information in. If a page having no blank lines to print information in, that is, a page in which all the lines are printed is opened, or if the other new page is opened though there is a page having blank lines to print information in before the opened page, it is determined that the booklet P is inserted with incorrect page opened. If it is determined that the booklet P is inserted with the incorrect page opened (NO in S6), the feed roller 6 is rotated to convey the booklet P in the conveyance direction A (S7). The booklet P passing through the first printing section 13 and the mergence section 29 reaches the page turning mechanism 40. At this time, since the degree of difference between the current correct page and the page which is opened actually of the booklet P is already known, the page turning mechanism 40 turns the page so that the correct page is opened (S8). In addition, as to the page turning mechanism, a well-known technology is used, and therefore the detailed description thereof is omitted. The booklet P the correct page of which is opened is conveyed in the conveyance direction B (S9), and is stopped at the printing position of the first printing section 13.

If it is determined that the booklet P is inserted with the correct page opened (YES in S6), the booklet P is conveyed in the conveyance direction A and stopped at the printing position of the first printing section 13. Next, the first printing section 13 carries out printing of one line on the booklet P (S10).

Then the control section 50 confirms whether or not all the printing is completed (S11). Generally, the printing carried out on the booklet P is one line in one transaction processing. However, in a case where there remains unprinted information to be printed on the booklet P, a plurality of lines of printing including the remained unprinted information and the information in the current transaction processing needs to be carried out. In order to print all the printing including the remained unprinted information, it is confirmed whether or not all the printing is completed herein.

If all the printing is not completed (NO in S11), the control section 50 determines whether or not the printing can be carried out in the next line (S12). That is because the printing cannot be continuously carried out in the page if, for example, the printing in S10 is carried out in the last printable line of the opened page of the booklet P. Thus, it is determined that whether or not the printing can be carried out in the next line.

If it is determined that the printing can be carried out in the next line (YES in S12), the first printing section 13 carries out printing in the next line. The printing is carried out until all the printing is completed.

If it is determined that the printing cannot be carried out in the next line (NO in S12), that is, in a case where there remains information to be printed even if the printing is carried out in the last printable line of the opened page of the booklet P, the control section 50 conveys the booklet P in the conveyance direction A (S13). The booklet P passing through the first printing section 13 and the mergence section 29 reaches the page turning mechanism 40. The page turning mechanism 40 turns the page of the booklet P to the next page (S14).

Since the booklet P reached the page turning mechanism 40, no booklet P is on the first paper conveyance path 5 from the insertion and discharging port 2 to the mergence section 29. Thus, during the period when the page of the booklet P is turned by the page turning mechanism 40, if the printing is carried out to create the business form C through the second printing section 26, the booklet P will not collide with the business form C on the first paper conveyance path 5, and the page turning operation and the printing operation of the second printing section 26 can be performed in parallel, which shortens the processing time.

If the page turning operation (S14) is started, the control section 50 confirms whether or not to print the content of the current transaction processing on the roll paper 15 to issue as a business form C (S15). The confirmation is performed based on the data stored in the business form printing confirmation section (not shown) arranged in the RAM 54. If the content of the current transaction processing is not printed on the roll paper 15 to issue as a business form C (NO in S15), the control section 50 rotates the flapper 28 anticlockwise with the flapper rotation mechanism (not shown) (S16) to communicate the second paper conveyance path 21 with the first paper conveyance path 5.

Then through the cooperation between the feed roller 22 and the idler roller 23, the roll paper 15 is conveyed in the conveyance direction B and the content of the current transaction processing is printed on the roll paper 15 by the second printing section 26 (S17). If the content of the current transaction processing is printed, the control section 50 rewrites the data stored in the business form printing confirmation section (not shown) arranged in the RAM 54 to the printed data (S18). If the printing of the content of the current transaction processing is completed, the cutter 27 is driven to cut the roll paper 15 (S19) to complete the business form C. Next, the feed roller 22 and the feed roller 6 are driven to convey the business form C in the conveyance direction B towards the insertion and discharging port 2 (S20). Then the business form C is conveyed to a position where the front end thereof cannot be detected by the collection sensor 31 and stopped on the first paper conveyance path 5.

Then the control section 50 stops the operation of the flapper rotation mechanism (not shown). As stated above, usually, the flapper 28 provided with the energization module (not shown) is energized clockwise by the energization module, thus, if the operation of the flapper rotation mechanism is stopped, the flapper 28 is rotated clockwise by the energization module (S21), and therefore the first paper conveyance path 5 from the insertion and discharging port 2 to the collection box 14 is communicated.

Then the control section 50 conveys the booklet P in the conveyance direction B (S22) and stops the booklet P at the printing position of the first printing section 13, and prints the printing content to be printed on the booklet P with the first printing section 13 (S10). In addition, even if in a case where the amount of printing carried out on the booklet P is so large that the booklet P needs to be conveyed to the page turning mechanism 40 again to turn a new page using the page turning mechanism 40 (S14), if the confirmation on whether or not the business form is printed (S15) is carried out, it is confirmed that the business form is printed (YES in S15) because the data stored in the business form printing confirmation section has been rewritten to the printed data. In this case, the booklet P is conveyed in the conveyance direction B while no printing is carried out on the roll paper 15 (S22).

A printing is carried out on the booklet P by the first printing section 13 (S10), then the control section 50 confirms whether or not all the printing is completed (S11). If it is determined that all the printing is completed (YES in S11), the control section 50 confirms whether or not to print the content of the current transaction processing on the roll paper 15 to issue as a business form C (S23). This confirmation is, as stated above, performed based on the data stored in the business form printing confirmation section (not shown) arranged in the RAM 54.

If the content of the current transaction processing is not printed on the roll paper 15 to issue as the business form C (NO in S23), the control section 50 rotates the flapper 28 anticlockwise through the flapper rotation mechanism (not shown) (S24) to communicate the second paper conveyance path 21 with the first paper conveyance path 5.

Then through the cooperation between the feed roller 22 and the idler roller 23, the roll paper 15 is conveyed in the conveyance direction B and the content of the current transaction processing is printed on the roll paper 15 by the second printing section 26 (S25). If the content of the current transaction processing is printed, the control section 50 rewrites the data stored in the business form printing confirmation section (not shown) arranged in the RAM 54 to the printed data (S26). If the printing of the content of the current transaction processing is completed, the cutter 27 is driven to cut the roll paper 15 (S27) to complete the business form C. Next, the feed roller 22 and the feed roller 6 are driven to convey the business form C in the conveyance direction B towards the insertion and discharging port 2 (S28). Then the business form C is conveyed to a position where the front end thereof cannot be detected by the collection sensor 31 and stopped on the first paper conveyance path 5.

Then the control section 50 rotates the flapper 28 clockwise (S29) by stopping the operation of the flapper rotation mechanism (not shown) to communicate the first paper conveyance path 5 from the insertion and discharging port 2 to the collection box 14.

Then the control section 50 conveys the booklet P in the conveyance direction B towards the insertion and discharging port 2 (S30). During the conveyance towards the insertion and discharging port 2, when the booklet P passes through the MS reading/writing section 9, the MS reading/writing section 9 writes the newest information such as the current transaction information and the like in the magnetic stripe arranged in the booklet P (S31), and then the control section 50 further conveys the booklet P in the conveyance direction B towards the insertion and discharging port 2.

If it is detected by a sensor (not shown) that the business form C passed through the MS reading/writing section 9, the business form C which is conveyed to a position where the front end thereof cannot be detected by the collection sensor 31 and stopped on the first paper conveyance path 5 is discharged to the outside of the printer apparatus 1 from the insertion and discharging port 2, and subsequently the booklet P is discharged to the outside of the printer apparatus 1 from the insertion and discharging port 2 (S32), as a result, the booklet P and the business form C are placed on the insertion and discharging table 30 in a state where the booklet P is overlaid on the business form C. In addition, though the booklet P and the business form C are discharged to the outside of the printer apparatus 1, it is assumed that the booklet P and the business form C are stopped in a position where part of the rear end thereof can be detected by the collection sensor 31, and the part thereof are clamped between the feed roller 6 and the idler roller 7.

The collection sensor 31 which is arranged above the insertion and discharging port 2 is used to detect whether or not there exists a business form C and a booklet P on the first paper conveyance path 5 nearby the insertion and discharging port 2. The collection sensor 31 outputs an ON-signal in a case of existence of a business form C and a booklet P, and outputs an OFF-signal in a case of nonexistence of a business form C and a booklet P.

The booklet P is placed on the insertion and discharging table 30 following the business form C. The existence of the booklet P and the business form C are detected by the collection sensor 31 when both of which are discharged. If the collection sensor 31 detects the business form C entering the detection position of the collection sensor 31 earlier than the booklet P, the control section 50 starts the timer 52 (S33).

Then the control section 50 confirms whether or not the business form C and the booklet P are taken away by the user (S34). The confirmation on whether or not the business form C and the booklet P are taken away by the user is carried out by confirming the signal of the collection sensor 31, and if the OFF-signal is output, it is determined that the business form C and the booklet P are taken away by the user.

The signal of the collection sensor 31 is confirmed, and if the OFF-signal is output, it is determined that the business form C and the booklet P are taken away by the user (YES in S34), and then the current processing is ended (S35). If the signal of the collection sensor 31 is confirmed, and as a result, the ON-signal is output, it is determined that the business form C and the booklet P are not taken away by the user (NO in S34), and then the control section 50 confirms whether or not a given time elapses from the moment the timer 52 is started when the business form C is detected by the collection sensor 31 (S36). The given time is a time used to determine that the user forgets to take away the business form C and the booklet P if the business form C and the booklet P are still at the position where the business form C and the booklet P can be detected by the collection sensor 31 after the time elapses, and the time can be randomly determined by the setter of the printer apparatus 1.

The control section 50 confirms whether or not the given time elapses according to the timer 52 (S36), and if it is determined that the given time does not elapse (NO in S36), there is a possibility that the user takes away the business form C and the booklet P, thus, it is re-confirmed whether or not the business form C and the booklet P are taken away (S34). It is confirmed whether or not the given time elapses according to the timer 52 (S36), and if the given time elapses (YES in S36), it is determined that the user forgets to take away the business form C and the booklet P.

Since personal information, transaction information and the like is recorded in the business form C and the booklet P, it is necessary to prevent the business form C and the booklet P from being given to other person by mistake, thus, if it is determined that the user forgets to take away the business form C and the booklet P, the feed roller 6 is rotated to convey the business form C and the booklet P in the conveyance direction A through cooperation with the idler roller 7 (S37). Further, at this time, the flapper 28 is rotated clockwise, and therefore the first paper conveyance path 5 from the insertion and discharging port 2 to the collection box 14 is communicated. Next, the business form C and the booklet P are conveyed in the conveyance direction A on the first paper conveyance path 5, passing through the mergence section 29 and the page turning mechanism 40, to be collected in the collection box 14 (S38) to end the processing (S39).

As stated above, in the present embodiment, the printer apparatus comprises an insertion and discharging port; a first paper conveyance path configured to convey a first printing medium inserted from the insertion and discharging port in a downstream direction towards a given printing position, and convey the first printing medium in a direction opposite to the downstream direction to discharge the first printing medium from the insertion and discharging port; a first printing section configured to carry out printing on the first printing medium conveyed to the printing position; a second printing section configured at the downstream side of the first printing section when seen from the direction of the insertion and discharging port; a second paper conveyance path configured to merge with the first paper conveyance path at the downstream side of the first printing section of the first paper conveyance path to discharge a second printing medium printed by the second printing section through the first paper conveyance path from the insertion and discharging port; and a page turning mechanism configured at the downstream side of a mergence section of the first paper conveyance path and the second paper conveyance path to have a page turning function of turning the page of the first printing medium. In this way, it is possible to carry out printing on the second printing medium during the period when the page turning operation is carried out on the first printing medium. The page turning operation carried out on the first printing medium and the printing operation carried out on the second printing medium can be performed in parallel, which makes it possible to shorten the processing time. Further, the page turning mechanism of the first printing medium is arranged at the downstream side of a mergence section of the first paper conveyance path and the second paper conveyance path, which will not impede the conveyance of the second printing medium. In addition, the collection box is further arranged at the downstream side of the page turning mechanism of the first printing medium, which is arranged at the downstream side of the mergence section of the first paper conveyance path and the second paper conveyance path, to collect a business form and a booklet a user forgets to take away. In this way, it is possible to reduce the time for conveying the first printing medium to perform the page turning mechanism of the first printing medium.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer apparatus, comprising:

an insertion and discharging port;

a first paper conveyance path configured to convey a first printing medium inserted from the insertion and discharging port in a downstream direction towards a given printing position, and convey the first printing medium in a direction opposite to the downstream direction to discharge the first printing medium from the insertion and discharging port;

a first printing section configured to carry out printing on the first printing medium conveyed to the printing position;

a second printing section configured at the downstream side of the first printing section when seen from the direction of the insertion and discharging port to have a printing method different from that of the first printing section, wherein the second printing section is configured to carry out printing on a second printing medium;

a second paper conveyance path configured to merge with the first paper conveyance path at the downstream side of the first printing section of the first paper conveyance path to discharge the second printing medium printed by the second printing section through the first paper conveyance path from the insertion and discharging port; and a page turning mechanism configured at the downstream side of a mergence section of the first paper conveyance path and the second paper conveyance path to have a page turning function of turning the page of the first printing medium;

wherein the second printing section carries out printing on the second printing medium and the second paper conveyance path discharges the second printing medium while the page turning mechanism turns the page of the first printing medium.

2. The printer apparatus according to claim 1, wherein the first printing section carries out printing in a serial printing method, and the second printing section carries out printing in a line printing method.

3. The printer apparatus according to claim 1, wherein the first printing section carries out printing in a dot matrix printing method, and the second printing section carries out printing in a thermal printing method.

4. The printer apparatus according to claim 1, further comprising:

a collection box configured at the downstream side of a page turning mechanism to collect the first printing medium and the second printing medium a user forgets to take away.

* * * * *